US008608451B2

(12) United States Patent
Gneuss

(10) Patent No.: US 8,608,451 B2
(45) Date of Patent: Dec. 17, 2013

(54) LIQUID RING VACUUM PUMP FOR DEGASSING MOLTEN PLASTIC

(75) Inventor: Detlef Gneuss, Bad Oeynhausen (DE)

(73) Assignee: Gneuss Kunststofftechnik GmbH, Bad Oeynhausen (DE)

( * ) Notice: Subject to any disclaimer, the term of this patent is extended or adjusted under 35 U.S.C. 154(b) by 49 days.

(21) Appl. No.: 13/201,496

(22) PCT Filed: Feb. 26, 2010

(86) PCT No.: PCT/EP2010/001205

§ 371 (c)(1),
(2), (4) Date: Aug. 26, 2011

(87) PCT Pub. No.: WO2010/097233

PCT Pub. Date: Sep. 2, 2010

(65) Prior Publication Data

US 2011/0300005 A1 Dec. 8, 2011

(30) Foreign Application Priority Data

Feb. 27, 2009 (DE) ..... 10 2009 010 702

(51) Int. Cl.
*F04B 49/00* (2006.01)

(52) U.S. Cl.
USPC ..... 417/69; 417/68; 417/313

(58) Field of Classification Search
USPC ..... 417/68, 69; 425/68, 70, 203
See application file for complete search history.

(56) References Cited

U.S. PATENT DOCUMENTS

| | | | | |
|---|---|---|---|---|
| 3,574,509 | A | 4/1971 | Zentis | |
| 3,664,509 | A | 5/1972 | Grill | |
| 7,794,211 | B2 | 9/2010 | Muhs | |
| 7,828,538 | B2 * | 11/2010 | Fellinger | 425/67 |
| 7,927,080 | B2 | 4/2011 | Muller | |

FOREIGN PATENT DOCUMENTS

| | | | |
|---|---|---|---|
| DE | 1908692 | A | 11/1969 |
| DE | 4118787 | A | 12/1992 |
| DE | 29615006 | A | 11/1996 |
| DE | 1548195 | A | 6/2005 |
| EP | 1161978 | A1 * | 12/2001 |
| WO | 0218032 | A | 3/2002 |

* cited by examiner

*Primary Examiner* — Charles Freay
*Assistant Examiner* — Patrick Hamo
(74) *Attorney, Agent, or Firm* — Andrew Wilford

(57) ABSTRACT

A liquid ring vacuum pump for degassing molten plastic has an inlet where gases are drawn in and an outlet through which gases are blown out. A closed circulation path for the compression fluid holds a replaceable filter insert for filtering coarse contaminants out of the compression liquid, a precondensation unit upstream of the pump inlet for filtering fine contaminants out of the compression liquid, and only one continuously operating fine or ultrafine filter in the closed circulation path. The closed circulation path is closed even when the fine filter or ultrafine filter is replaced. A controller connected to the continuously operating filter directs replacement of the filter element as a function of degree of contamination, filtering time, pressure conditions, or flow velocity conditions at the filter.

8 Claims, 1 Drawing Sheet

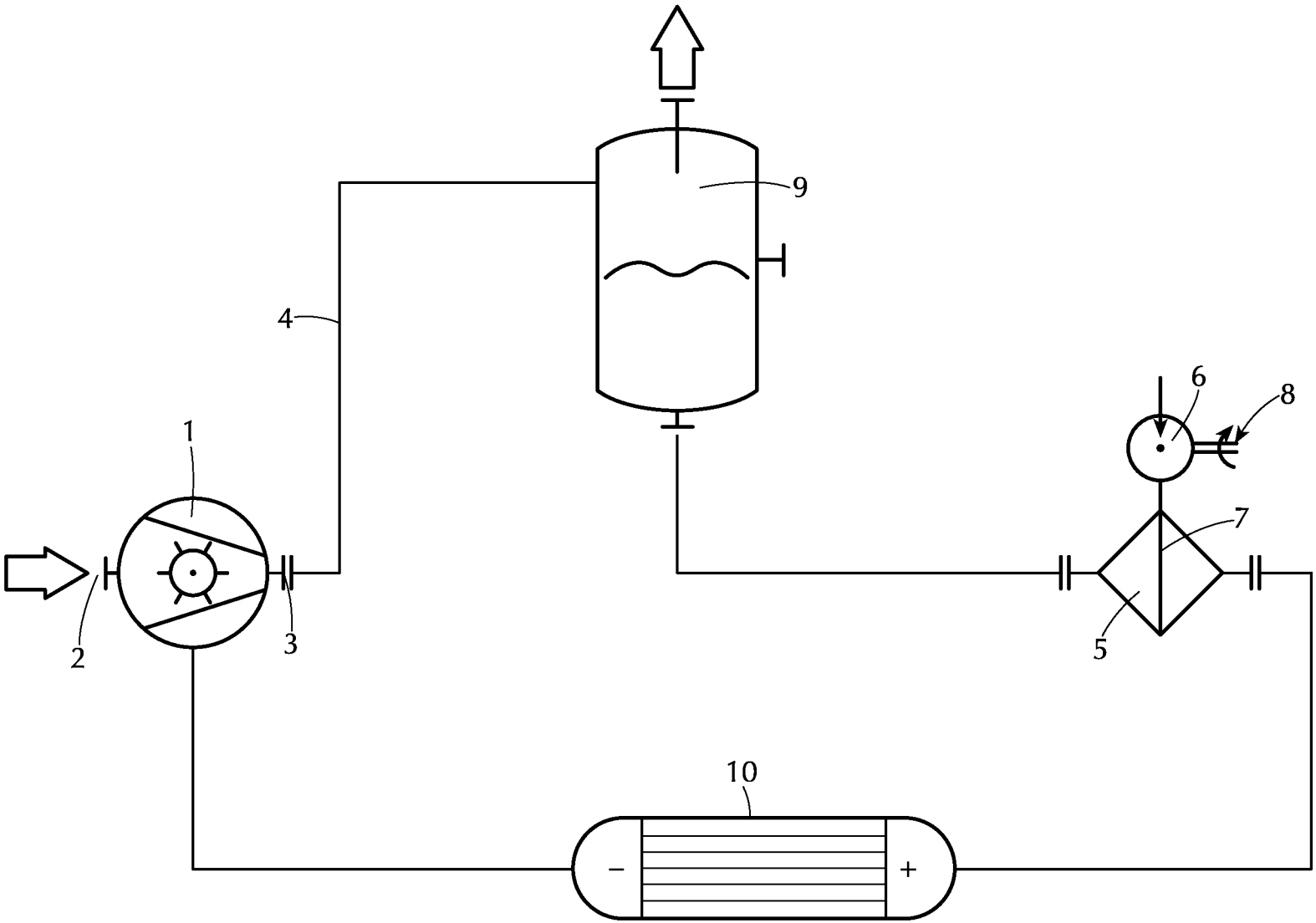
1
2
3
4
5
6
7
8
9
10
+
-

LIQUID RING VACUUM PUMP FOR DEGASSING MOLTEN PLASTIC

CROSS REFERENCE TO RELATED APPLICATIONS

This application is the US-national stage of PCT application PCT/EP2010/001205 filed 26 Feb. 2010, published 2 Sep. 2010 as WO2010/097233, and claiming the priority of German patent application 102009010702.9 itself filed 27 Feb. 2009.

FIELD OF THE INVENTION

The invention relates to a liquid ring vacuum pump for degassing molten plastic and having an inlet where gases are drawn in and an outlet through which gases are discharged, and for the compression liquid a closed circulation path in which a replaceable filter insert is provided for filtering coarse contaminants out of the compression liquid, and optionally comprising a precondensation unit upstream of the pump inlet for filtering fine contaminants out of the compression liquid.

BACKGROUND OF THE INVENTION

Liquid vacuum pumps of this type are employed, for example to degas extruders. When, possibly toxic gases are drawn in, it is also possible for contaminants, such as, for example melt particles, etc., to be aspirated as well. Both the toxic components of the gases as well as the contaminants are largely absorbed by the compression liquid. In order to prevent these absorbed and possibly coarser contamination particles from causing any damage to the liquid ring vacuum pump, a known approach is to clean the compression liquid in a closed circulation path that includes a replaceable filter insert, for example a candle filter. The disadvantage here is that the closed circulation path must be interrupted to replace the candle filter whenever the candle filter has become clogged after an extended period of use.

Another approach is known in principle where finer contaminants, such as for example toxic components upstream of the pump, are filtered out by precondensation units. These contaminants are intended to condense out here. They are deposited in the precondensation unit and must be disposed of from time to time. However, the contaminants condense only at a significant cost, in particular, in terms of cooling capacity, due to the high temperatures of the plastic melt gases, with the result that the known precondensation units function in an unsatisfactory and inadequate fashion.

As a result, two filter units are required if both coarse as well as fine particles are to be collected. In order to clean or replace the filter inserts, at least the compression-liquid closed circulation path must be interrupted, and possibly the entire liquid ring vacuum pump must be stopped. In order to clean the precondensation unit, typically two expensive condensers must be provided, so one of the condensers can operate while the other condenser is undergoing elaborate cleaning, for example by solvents, and its waste must be transferred to the hazardous waste area.

DE 296 15 006 discloses a circulation system for water ring pumps in which coarse contaminants are separated from the compression liquid along an inclined plane, while finer contaminants are filtered through a cylindrical, spherical, or conical filter. If, however, the inclined plane and/or the filter gets clogged, the closed closed circulation path must be opened to enable cleaning, and the contaminants then removed. Continuous operation is thus just as impossible as is the filtering of ultrafine contaminants.

DE 41 18 787 discloses a process-integrated working-fluid cleaning system for compressors in which the working fluid of the compressor is cleaned by a pervaporation-membrane module. A membrane is employed here through which the contaminated working fluid can pass. After passing through the membrane, the contaminants evaporate on the back side of the membrane. This enables only evaporating contaminants to be extracted from the compression liquid. The membrane would clog up if there were solids in the compression liquid. The membrane would then have to be replaced. To do this, the liquid ring vacuum pump would also have to be stopped and the otherwise closed closed circulation path for the compression liquid would have to be opened.

If the goal is to degas polyester melts with toxic contaminants, relatively large quantities of water are drawn in aside from contaminants by the liquid ring vacuum pump. These quantities of water are transferred to the compression liquid. This water must be extracted from the closed circulation path of the compression liquid. Special care must be taken to ensure an especially thorough cleaning of the compression liquid so that this water also does not have to be disposed of as hazardous waste.

OBJECT OF THE INVENTION

The object of this invention is therefore to provide a liquid ring vacuum pump such that the pump can continue to operate uninterrupted even during filter replacement, and such that the compression-liquid closed circulation path does not have to be interrupted. The invention furthermore aims to create sustainable stable process conditions, to enable the handling of the filter system to be simple and cost-effective, and to be designed in an energy-saving and environmentally-compatible manner.

SUMMARY OF THE INVENTION

This object is attained in that the compression-liquid closed circulation path is always closed and has only one continuously operating filter, so the filter can be a fine filter or ultrafine filter. It is of course understood that the ultrafine filter can also effect fine filtering. In addition, the ultrafine filter is designed so as to pick up even the toxic components of the compression liquid, with the result that expensive precondensation units that are costly to operate can be eliminated.

The compression-liquid closed circulation path, which is closed even during a filter change, ensures that no interruptions of the closed circulation path and no stopping of the liquid ring vacuum pump are necessary for the filter change. The continuously operating filter here guarantees that if the filter surface being used is about to clog up, it can be replaced with a new or cleaned filter surface.

Possible filters include a trough bed filter operating with endless fleece filter cloth, or a back-flushable rotary or slide-in filter. The filter cloth here, which is taken out of the filter after filtering has been performed, can be cleaned. It is, however, also possible to dispose of the filter cloth as hazardous waste, so long as there is a sufficient supply of new filter cloth.

Ultrafine filters with filtration fineness ratings of <5 μm have proven successful. When filters with filtration fineness ratings of >5 μm are used, it has been found that the coarse contaminants and even finer suspended matter can be separated from the compression liquid. Using filter sizes of <5 μm, it is possible to filter out from the compression liquid is even those contaminants that have been dissolved in the compression liquid. An optimal cleaning of the compression liquid can thus also be achieved from an environmental aspect.

It is advantageous if a controller is associated with the continuously operating filter to direct replacement of the filter element as a function of the degree of contamination and/or the filtering time and/or the pressure conditions at the filter and/or the flow velocity at the filter. The possibility obviously also exists for an operator to monitor the degree of contamination of the filter and to perform a transfer of the filter elements manually.

If one of the two connectors of the closed circulation path is created by the pump outlet, it is possible to eliminate one connector on the liquid ring vacuum pump, with the result that the liquid ring vacuum pump can be of smaller construction. A liquid separator can be provided to separate the exhaust air from the compression liquid, the liquid separator being disposed outside the liquid ring vacuum pump.

An approach has proven successful where a cooler is provided in the closed circulation path. This makes it easy to dissipate the heat that is generated in the liquid ring vacuum pump during compression of the gas.

An advantageous approach is to employ water as the compression liquid. This provides for an especially effective operation of the liquid ring vacuum pump.

The liquid ring vacuum pump is also especially well-suited for degassing polyester melts in which the gases drawn in contain relatively large quantities of water.

BRIEF DESCRIPTION OF THE DRAWING

The invention is described below in more detail based on a sole FIGURE shown in the attached drawing.

DETAILED DESCRIPTION OF THE INVENTION

The sole drawing FIGURE here shows a liquid ring vacuum pump 1, having an inlet 2 and an outlet 3. The pump 1 is integrated into a closed circulation path 4 in which the compression liquid is processed. The closed circulation path 4 has a continuously operating filter 5 whose motor 6 is operated to replace the filter element 7 by a controller 8 as a function of contamination of the filter's element.

A pump connector 3 is provided that also serves as a connection for the closed circulation path 4. The gas extracted from the compression liquid is separated in a liquid separator 9, the liquid coming from the liquid separator 9 to the continuously operating filter 5. In addition, a cooler 10 is provided to bring the compression liquid is brought to a desired level.

The invention claimed is:

1. A liquid ring vacuum pump for degassing molten plastic, the pump comprising:

an inlet where gases are drawn in;

an outlet through which gases are blown out;

a closed circulation path for the compression fluid;

a replaceable filter insert in the path for filtering coarse contaminants out of the compression liquid;

a precondensation unit upstream of the pump inlet for filtering fine contaminants out of the compression liquid;

only one continuously operating fine or ultrafine filter in the closed circulation path, the closed circulation path being closed even when the fine filter or ultrafine filter is replaced; and a controller connected to the continuously operating filter for directing replacement of the filter element as a function of degree of contamination, filtering time, pressure conditions, or flow velocity conditions at the filter.

2. The liquid ring vacuum pump according to claim 1, wherein the continuously operating filter is a trough bed filter operating with an endless fleece filter cloth.

3. The liquid ring vacuum pump according to claim 1, wherein the continuously operating filter is a back-flushable rotary filter or slide-in filter.

4. The liquid ring vacuum pump according to claim 1, wherein the filter is ultrafine and has filter fineness ratings of $<5\ \mu m$.

5. The liquid ring vacuum pump according to claim 1, further comprising:

one connector of the closed circulation path formed by the pump outlet; and a liquid separator downstream from the pump outlet and through which gas exhausted from the compression liquid is separated and can be discharged while the compression liquid is fed into the closed circulation path.

6. The liquid ring vacuum pump according to claim 1, further comprising:

a cooler in the closed circulation path.

7. The liquid ring vacuum pump according to claim 1, wherein the compression liquid is water.

8. The liquid ring vacuum pump according to claim 1, wherein the molten plastic is a polyester melt.

* * * * *